US012540618B2

(12) United States Patent
Kemp et al.

(10) Patent No.: US 12,540,618 B2
(45) Date of Patent: Feb. 3, 2026

(54) VALVE FOR ROTARY FLUID DISPLACEMENT ASSEMBLY AND ROTARY FLUID DISPLACEMENT ASSEMBLY COMPRISING SAME

(71) Applicant: TORAD, INC., Cumming, GA (US)

(72) Inventors: Gregory T. Kemp, Alparetta, GA (US); John Montgomery, Libum, GA (US); Joseph S. Orosz, Woodstock, GA (US); Gary Parsons, Potomac, MD (US); Jim Blankemeyer, Greenville, SC (US)

(73) Assignee: TORAD, INC., Cumming, GA (US)

( * ) Notice: Subject to any disclaimer, the term of this patent is extended or adjusted under 35 U.S.C. 154(b) by 0 days.

(21) Appl. No.: 18/877,732

(22) PCT Filed: Jul. 7, 2023

(86) PCT No.: PCT/US2023/027058

§ 371 (c)(1),
(2) Date: Dec. 20, 2024

(87) PCT Pub. No.: WO2024/010884

PCT Pub. Date: Jan. 11, 2024

(65) Prior Publication Data

US 2025/0382960 A1 Dec. 18, 2025

Related U.S. Application Data

(60) Provisional application No. 63/359,412, filed on Jul. 8, 2022.

(51) Int. Cl.
*F04C 18/34* (2006.01)
*F04C 18/344* (2006.01)
*F04C 29/12* (2006.01)

(52) U.S. Cl.
CPC ..... *F04C 18/3442* (2013.01); *F04C 29/126* (2013.01)

(58) Field of Classification Search
CPC ..... F04C 18/3442; F04C 18/0261; F04C 29/126; F04C 29/12; F04C 29/128; F04C 29/124; F04C 29/00; F04C 29/028; F04C 28/24
See application file for complete search history.

(56) References Cited

U.S. PATENT DOCUMENTS 4,051,893 A * 10/1977 Guibert ..... F24F 9/00 165/125
4,428,195 A * 1/1984 Linder ..... F04C 28/06 60/397
5,409,360 A * 4/1995 Wycliffe ..... F01C 21/08 418/234

(Continued)

*Primary Examiner* — Dapinder Singh
(74) *Attorney, Agent, or Firm* — Ballard Spahr LLP

(57) ABSTRACT

A rotary fluid-displacement assembly has a rotor housing assembly defining one or more valve cavities. Each valve cavity can be elongated along the longitudinal axis. Each valve cavity can define an opening in the internal cavity. The rotary fluid-displacement assembly can have respective discharge valve assembly for each valve cavity. Each discharge valve assembly can comprise a blocking element that is configured to be movably disposed in one respective valve cavity of the at least one valve cavity.

20 Claims, 9 Drawing Sheets

(56) References Cited

U.S. PATENT DOCUMENTS

| | | | | |
|---|---|---|---|---|
| 6,893,229 | B2 * | 5/2005 | Choi | F04C 18/0207 417/310 |
| 9,022,759 | B2 * | 5/2015 | Magadum | F04C 18/0215 137/625.33 |
| 9,651,042 | B2 * | 5/2017 | Blank | F04C 2/3442 |
| 10,683,864 | B2 * | 6/2020 | Heaps | F04C 18/3441 |
| 2006/0133946 | A1 * | 6/2006 | Mathers | F04C 2/3447 418/122 |
| 2010/0183453 | A1 * | 7/2010 | Milliff | F04C 18/0215 417/310 |

* cited by examiner

VALVE FOR ROTARY FLUID DISPLACEMENT ASSEMBLY AND ROTARY FLUID DISPLACEMENT ASSEMBLY COMPRISING SAME

CROSS-REFERENCE TO RELATED APPLICATIONS

This application claims priority to and the benefit of the filing date of U.S. Provisional Application No. 63/359,412, filed Jul. 8, 2022, the entirety of which is hereby incorporated by reference herein.

FIELD

This application relates to devices and systems for rotary fluid displacement assemblies such as, for example, spool compressors.

BACKGROUND

Referring to FIGS. 1-3, in a conventional spool compressor 100, a vane 102 rotates within an internal volume 104, compressing gas in a compression chamber 106 and releasing compressed gas from the compression chamber through one or more the discharge ports 108 as regulated by respective poppet valves 110. Conventionally, poppet valves 110 are round and can rotate axially around guideposts. Further, the conventional poppet valves 110 have a valve face 112 that is spaced a sufficient distance from the discharge port in the cylinder to avoid a tip seal 120 of the vane 102 striking the valve face 112 as the tip seal travels over the discharge port 108. These round poppet valves 110 have certain characteristics that lead to efficiency reduction of the conventional spool compressor. For example, discharge gas momentum favors trailing side of the poppet valve, so gas flows though better through the trailing 50% of valve. Further, side flow area requirements around the valve body limit the number of valves that can be installed, and thus, potential outflow. Conventional poppet valves generally need substantial lift to achieve adequate flow. Heavy valves and high lift result in slow dynamic response opening and closing the valve resulting in pumping losses and backflow. Accordingly, a more efficient system is desirable.

SUMMARY

Disclosed herein, in one aspect, is a rotary fluid-displacement assembly comprising a rotor housing assembly having an outer wall surface and defining an internal cavity having an inner wall surface. The rotor housing assembly can have a longitudinal axis. The rotor housing assembly can comprise at least one valve cavity defined in the rotor housing assembly extending radially from the inner wall surface of the internal cavity to the outer wall surface of the rotor housing assembly. The at least one valve cavity can be elongated along the longitudinal axis. Each valve cavity of the at least one valve cavity can define an opening to the internal cavity. The rotor housing assembly can further comprise at least one discharge valve assembly. Each discharge valve assembly can comprise a blocking element that is configured to be movably disposed in a respective valve cavity. The discharge valve assembly can further comprise at least one guide body. The blocking element can be slidable along the at least one guide body about and between a first position, in which at least a portion of the blocking element blocks the respective opening of the at least one valve cavity, and a second position, in which at least a portion of the respective blocking element is displaced from the respective opening of the at least one valve cavity. The discharge valve assembly can further comprise at least one biasing element that biases the respective blocking element toward the first position. The rotor housing assembly can comprise a rotor having a peripheral surface. The rotor can be positioned within the internal cavity of the rotor housing assembly. The rotor can be configured to rotate about a rotor axis of rotation that is parallel to or generally parallel to the longitudinal axis. The rotor housing assembly can comprise a vane having opposed portions, each opposed portion having a distal end, the opposed portions of the vane being slidably coupled to the rotor. At least portions of the peripheral surface of the rotor, portions of the inner wall surface of the rotor housing assembly, and varying portions of the vane proximate the distal ends of opposed portions of the vane can define a compression chamber of varying volume as the rotor rotates about the rotor axis of rotation. Each discharge valve assembly of the at least one discharge valve assembly can be movable from the first closed position to the second open position when a compression chamber pressure reaches a pressure sufficient to overcome an opposing force. The opposing force can be a combination of a biasing force of the biasing element and a back pressure within the respective valve cavity.

In some aspects, the at least one blocking element comprises a blocking surface that is configured to cover the opening of the at least one valve cavity. The inner wall surface of the internal cavity of the rotor housing assembly has a contour (e.g., a radius), and the blocking surface has a curvature with a contour that is the same as or substantially the same as the radius of the inner wall surface of the inner cavity.

Additional advantages of the disclosed system and method will be set forth in part in the description which follows, and in part will be understood from the description, or may be learned by practice of the disclosed system and method. The advantages of the disclosed system and method will be realized and attained by means of the elements and combinations particularly pointed out in the appended claims. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the disclosed apparatus, system, and method and together with the description, serve to explain the principles of the disclosed apparatus, system, and method.

DETAILED DESCRIPTION

Figure 1:
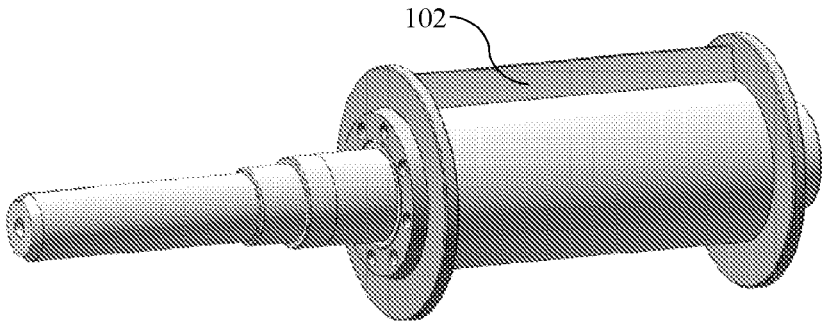
FIG. 1 is a perspective view of a rotor and a vane of a conventional spool compressor.

The disclosed system and method may be understood more readily by reference to the following detailed description of particular embodiments and the examples included therein and to the Figures and their previous and following description.

It is to be understood that the terminology used herein is for the purpose of describing particular embodiments only and is not intended to limit the scope of the present invention which will be limited only by the appended claims.

"Optional" or "optionally" means that the subsequently described event, circumstance, or material may or may not occur or be present, and that the description includes instances where the event, circumstance, or material occurs or is present and instances where it does not occur or is not present.

Ranges may be expressed herein as from "about" one particular value, and/or to "about" another particular value. When such a range is expressed, also specifically contemplated and considered disclosed is the range from the one particular value and/or to the other particular value unless the context specifically indicates otherwise. Similarly, when values are expressed as approximations, by use of the antecedent "about," it will be understood that the particular value forms another, specifically contemplated embodiment that should be considered disclosed unless the context specifically indicates otherwise. It will be further understood that the endpoints of each of the ranges are significant both in relation to the other endpoint, and independently of the other endpoint unless the context specifically indicates otherwise. Finally, it should be understood that all of the individual values and sub-ranges of values contained within an explicitly disclosed range are also specifically contemplated and should be considered disclosed unless the context specifically indicates otherwise. The foregoing applies regardless of whether in particular cases some or all of these embodiments are explicitly disclosed.

Optionally, in some aspects, when values or characteristics are approximated by use of the antecedents "about," "substantially," or "generally," it is contemplated that values within up to 15%, up to 10%, up to 5%, or up to 1% (above or below) of the particularly stated value or characteristic can be included within the scope of those aspects.

Unless defined otherwise, all technical and scientific terms used herein have the same meanings as commonly understood by one of skill in the art to which the disclosed apparatus. system, and method belong. Although any apparatus, systems, and methods and materials similar or equivalent to those described herein can be used in the practice or testing of the present apparatus, system, and method, the particularly useful methods, devices, systems, and materials are as described.

Throughout the description and claims of this specification, the word "comprise" and variations of the word, such as "comprising" and "comprises," means "including but not limited to," and is not intended to exclude, for example, other additives, components, integers or steps. In particular, in methods stated as comprising one or more steps or operations it is specifically contemplated that each step comprises what is listed (unless that step includes a limiting term such as "consisting of"), meaning that each step is not intended to exclude, for example, other additives, components, integers or steps that are not listed in the step.

Figure 5:
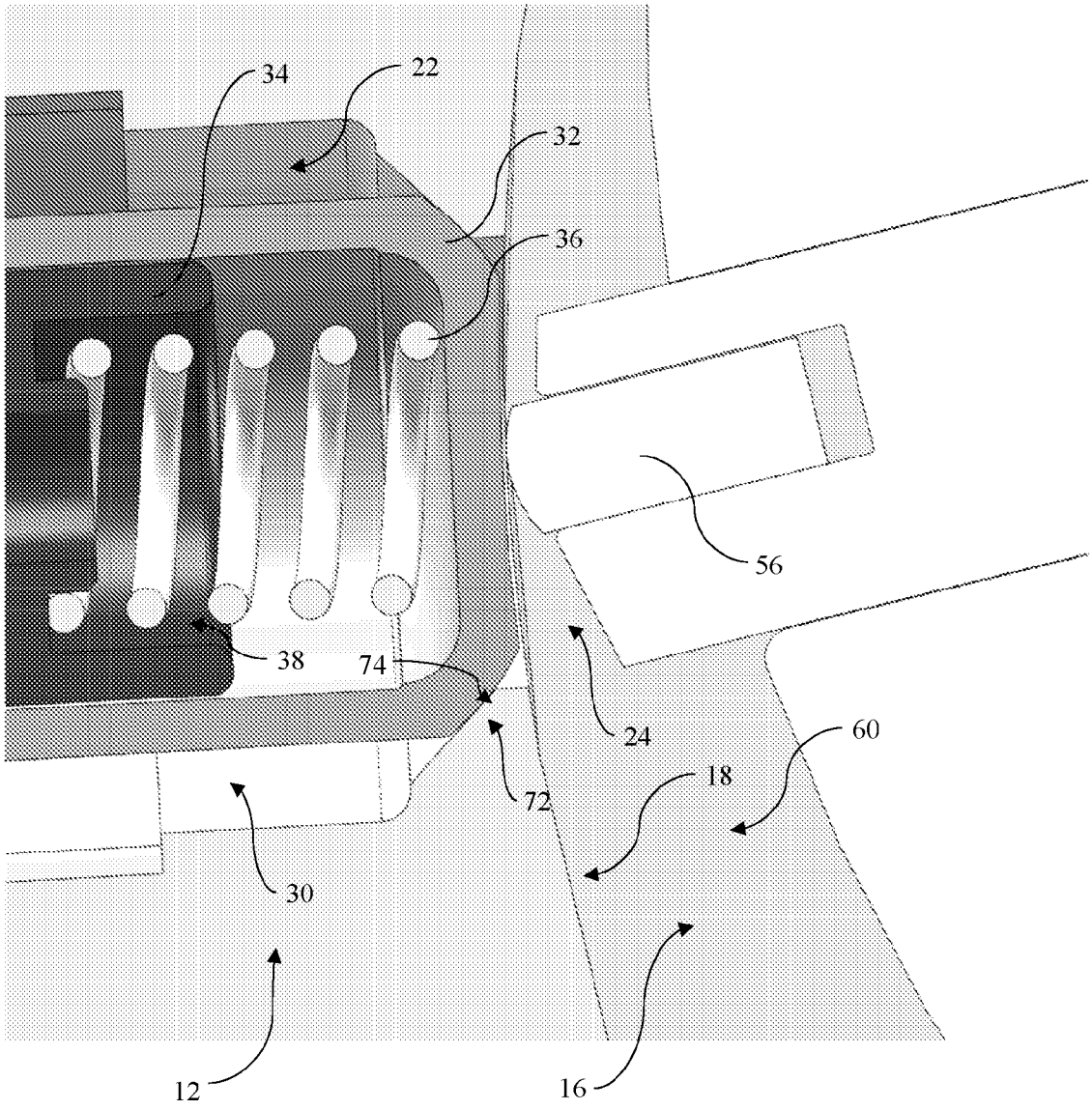
FIG. 5 is a partial cross sectional view of an exemplary rotary fluid-displacement assembly as disclosed herein.
Figure 9:
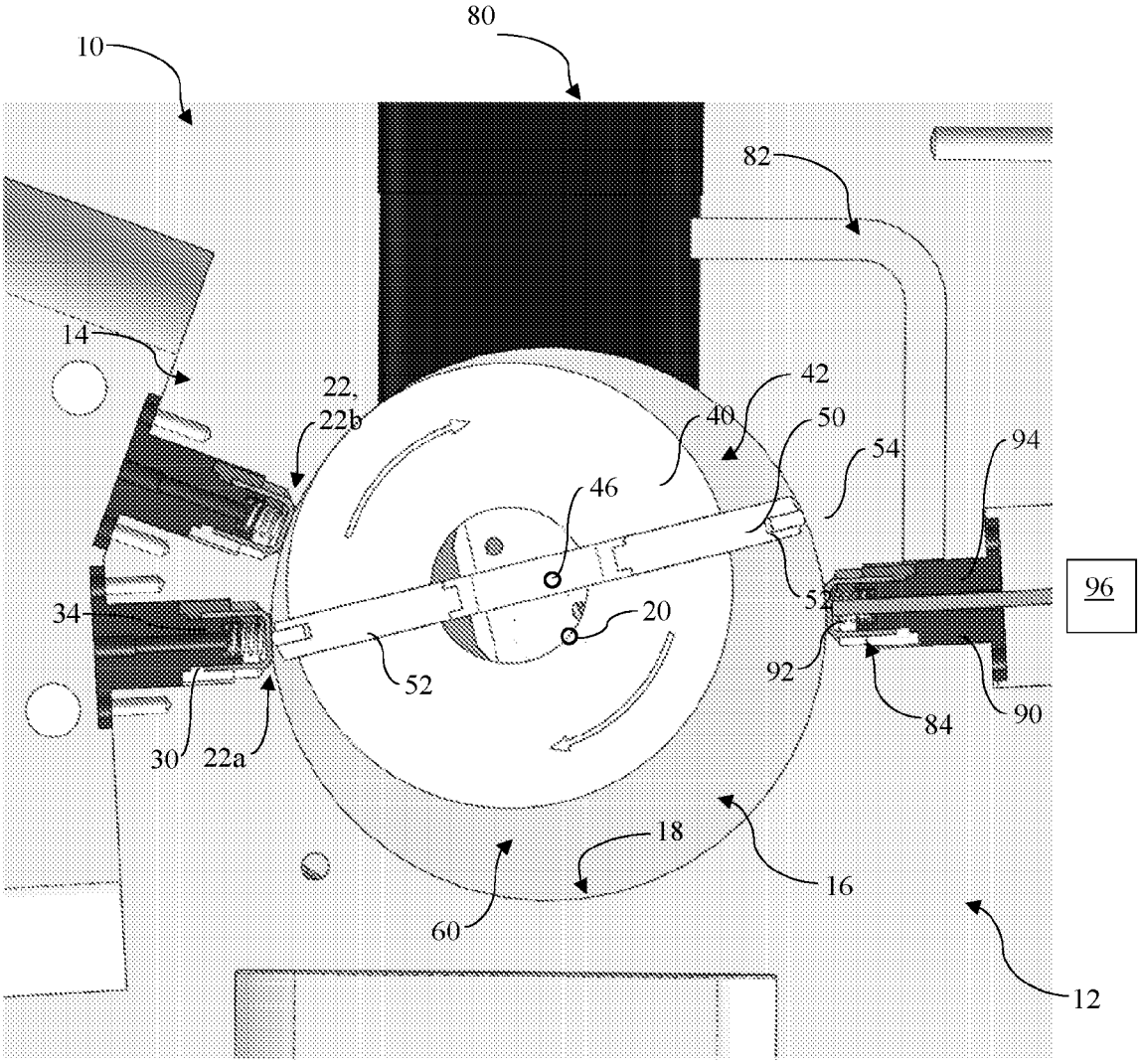
FIG. 9 is a cross sectional view of an exemplary rotary fluid-displacement assembly as disclosed herein.

Disclosed herein, with reference to FIGS. 5 and 9, is a rotary fluid-displacement assembly 10 comprising a rotor housing assembly 12 having an outer wall surface 14 and defining an internal cavity 16 having an inner wall surface 18. The rotor housing assembly can have a longitudinal axis 20.

The rotor housing assembly 12 can comprise at least one valve cavity 22 defined in the rotor housing assembly extending radially from the inner wall surface 18 of the internal cavity 16 to the outer wall surface 14 of the rotor housing assembly. The at least one valve cavity 22 can be elongated along (optionally, parallel to, or generally parallel to) the longitudinal axis 20. Each valve cavity 22 of the at least one valve cavity can define an opening 24 to the internal cavity 16.

The rotor housing assembly 12 can further comprise at least one discharge valve assembly 30. As further disclosed herein, it is contemplated that the disclosed discharge valve assembly 30 can provide a larger flow perimeter per unit weight and require less lift than a conventional poppet valve, thereby providing improvements in dynamic performance and compressor efficiency and decreasing backflow.

Each discharge valve assembly 30 can comprise a blocking element 32 that is configured to be movably disposed in a respective valve cavity 22. The discharge valve assembly 30 can further comprise at least one guide body 34. The blocking element 32 can be slidable along the at least one guide body 34 about and between a first position, in which at least a portion of the blocking element 32 blocks the respective opening 24 of the at least one valve cavity 22, and a second position, in which at least a portion of the respective blocking element is displaced from the respective opening 24 of the at least one valve cavity 22. By providing an elongated valve cavity 22 and corresponding elongated blocking element 32, the rotor housing assembly can provide sufficient flow area to minimize pressure drop (and prevent corresponding momentum/pumping losses) while discharging. Further, the elongated valve cavity 22 and corresponding elongated blocking element 32 can provide an improved ratio of flow area to mass of the moving blocking element 32 (as compared to a round poppet valve), thereby permitting improved opening and closing rates. In various aspects, the opening 24 (and corresponding blocking element 32) can have a length along the longitudinal axis 20 that is at least twice a dimension perpendicular to the longitudinal axis 20. For example, the opening 24 (and corresponding blocking element 32) can have a length that is at least 2 times, at least 3 times, at least 4 times, at least 5 times, or at least 6 times the dimension perpendicular to the longitudinal axis 20 (e.g., a length that is from 2× to 20×, or from 3× to 10× the dimension perpendicular to the longitudinal axis 20).

The discharge valve assembly 30 can further comprise at least one biasing element 36 that biases the respective blocking element toward the first position. In exemplary aspects, each guide body 34 can define an inner bore 38, and the at least one biasing element 36 can be a respective spring at least partly received within the inner bore of each guide body of the at least one guide body.

The rotor housing assembly 12 can comprise a rotor 40 having a peripheral surface 42. The rotor can be positioned within the internal cavity 16 of the rotor housing assembly 12. The rotor 40 can be configured to rotate about a rotor axis of rotation 46 that is parallel to or generally parallel to the longitudinal axis 20. The rotor housing assembly 12 can comprise a vane 50 having opposed portions 52, each opposed portion having a distal end 54, with the opposed portions of the vane being slidably coupled to the rotor 40.

At least portions of the peripheral surface 42 of the rotor 40, portions of the inner wall surface 18 of the rotor housing assembly, and varying portions of the vane 50 proximate the distal ends 54 of opposed portions 52 of the vane can define a compression chamber 60 of varying volume as the rotor rotates about the rotor axis of rotation. The vane 50 can comprise tip seals 56 at the distal ends 54 of the opposed portions 52.

Each discharge valve assembly 30 of the at least one discharge valve assembly can be movable from the first closed position to the second open position when a compression chamber pressure (i.e., pressure in the compression chamber 60) reaches a pressure sufficient to overcome an opposing force. The opposing force can be a combination of a biasing force of the biasing element and a back pressure within the respective valve cavity 22.

In some optional aspects, the at least one biasing element 34 of the at least one discharge valve assembly 30 can comprise a respective biasing element for each guide body of the at least one guide body.

Figure 6:
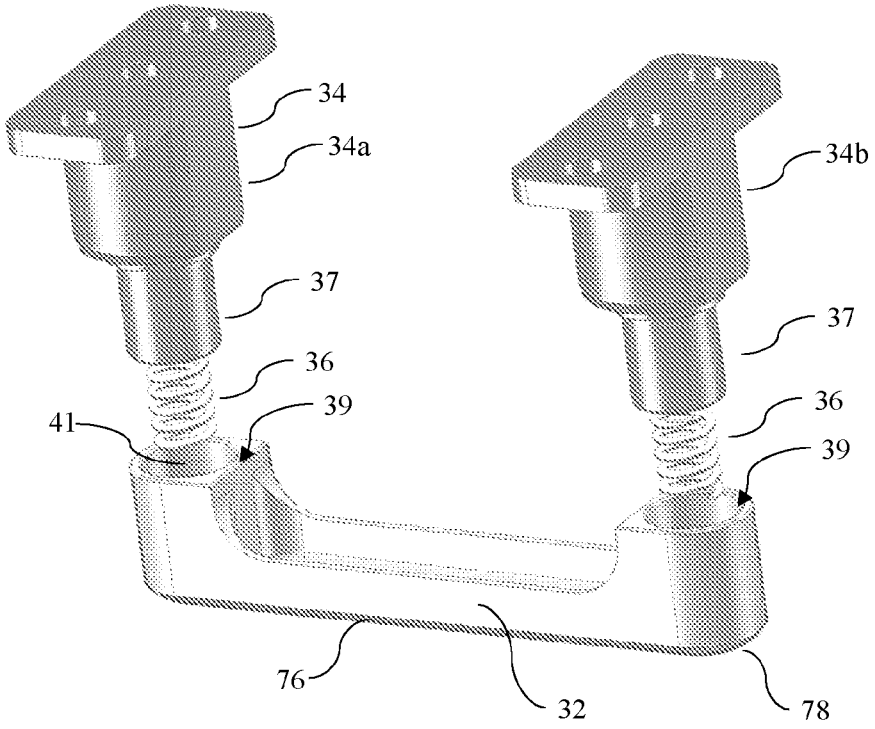
FIG. 6 is an exploded view of a discharge valve assembly of an exemplary rotary fluid-displacement assembly as disclosed herein.
Figure 7:
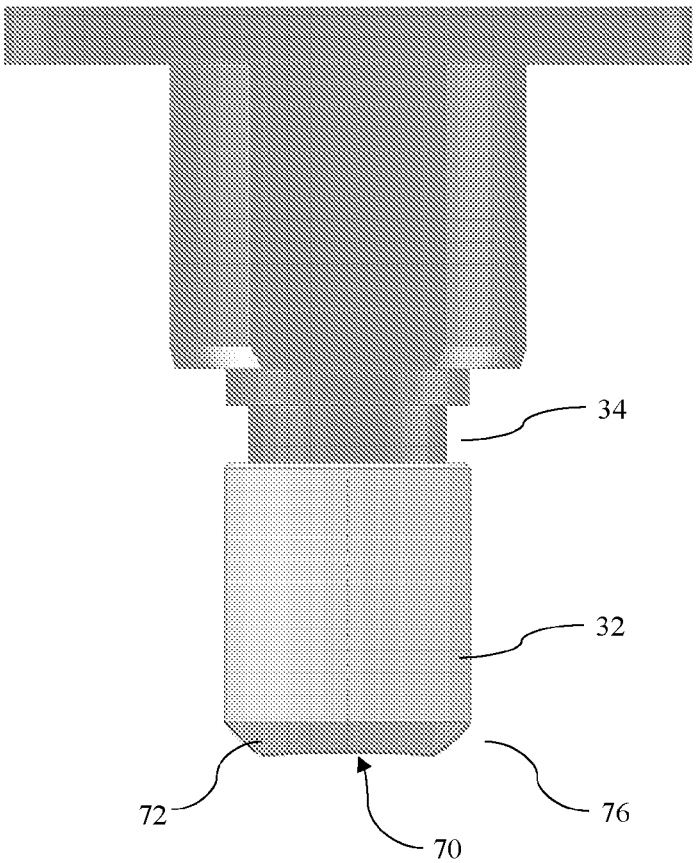
FIG. 7 is an end view of the discharge valve assembly of FIG. 6.

Referring to FIGS. 6-7, in some aspects, the at least one guide body 34 can comprise a first guide body 34*a* and a second guide body 34*b* spaced along the longitudinal axis 20. By supporting the blocking element 32 by a plurality of guide bodies, the blocking element can have enhanced stability, thereby enhancing sealing and reducing leakage of the discharge valve assembly 30.

The at least one guide body 34 can define an outer surface 37. In some further aspects, the at least one blocking element 32 can define a respective receptacle 39 that receives each guide body 34 of the at least one guide body of the discharge valve assembly 30. The respective receptacle 39 can have has an inner surface 41 that is complementary to the outer surface 37 of the respective guide body 34. In some optional aspects, the outer surface 37 defined by the at least one guide body 34 can be cylindrical.

The at least one blocking element 32 can comprise a blocking surface 70 that is configured to cover the opening 24 of the at least one valve cavity 22. The at least one blocking element 32 can further comprise a beveled or rounded edge 72 that extends peripherally about the blocking surface 70. As illustrated in FIGS. 5 and 7, the beveled or rounded edge 72 of the at least one blocking element 32 can have a slightly convex surface. The rotor housing assembly 12 can define a corresponding peripheral chamfer 74 that is configured to mate with the beveled or rounded edge 72 of the at least one blocking element 32. In this way, the rotor housing assembly 12 can accommodate the directional momentum of the gas exiting the valve to prevent additional pressure drop and losses.

Figure 2A:
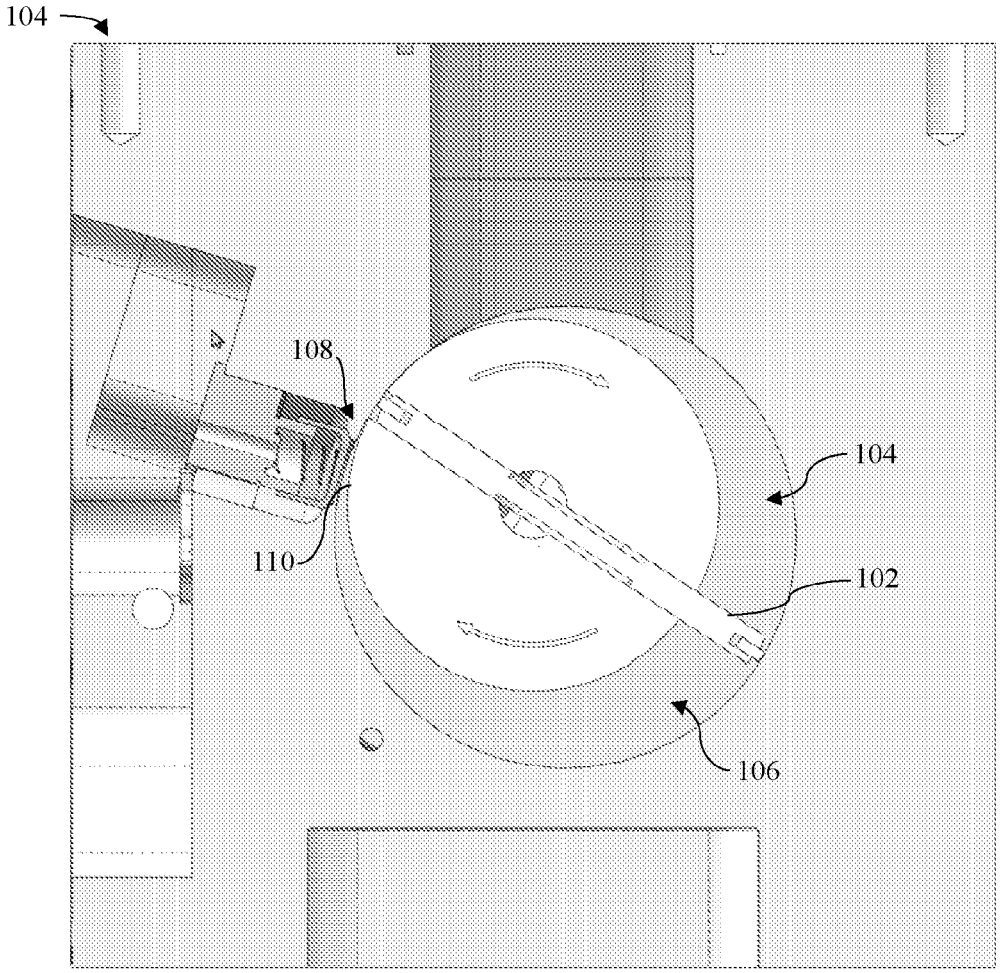
FIG. 2A is a cross sectional view of a conventional spool compressor.
Figure 2B:
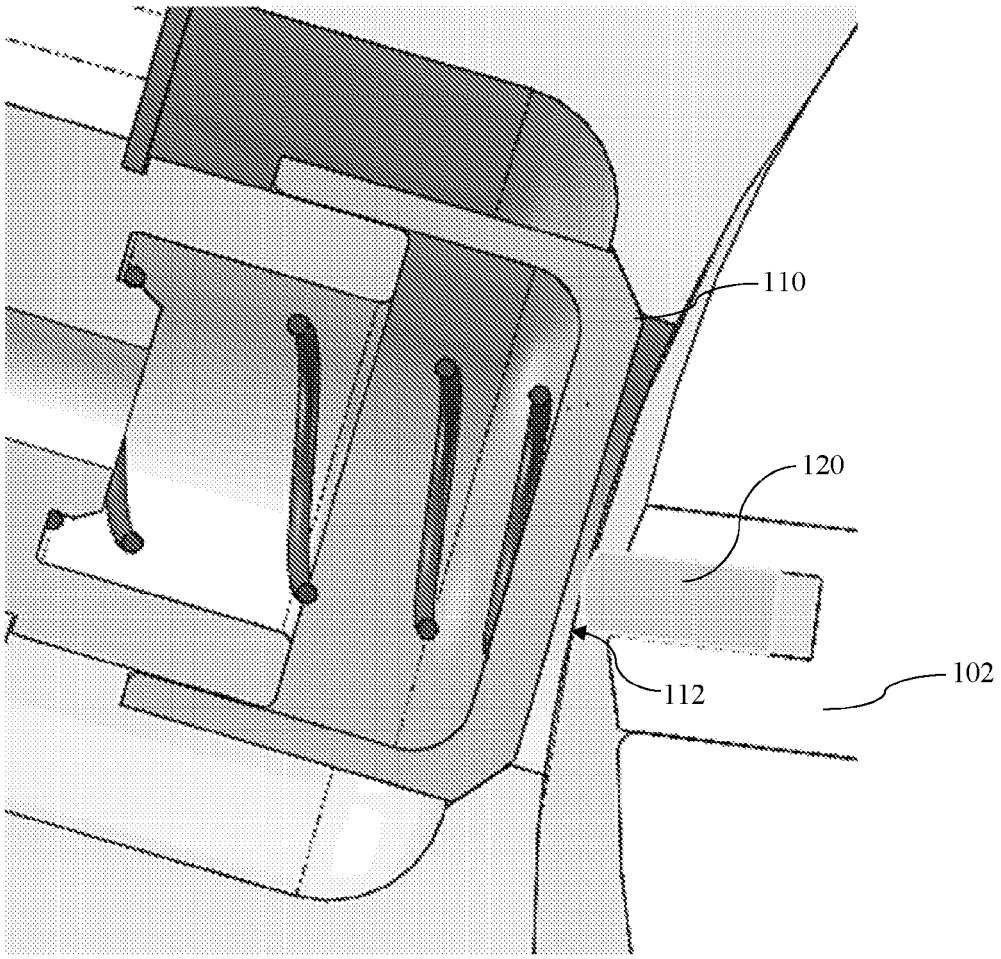
FIG. 2B is a close-up detail partial cross sectional view of the conventional spool compressor of FIG. 2A.
Figure 3:
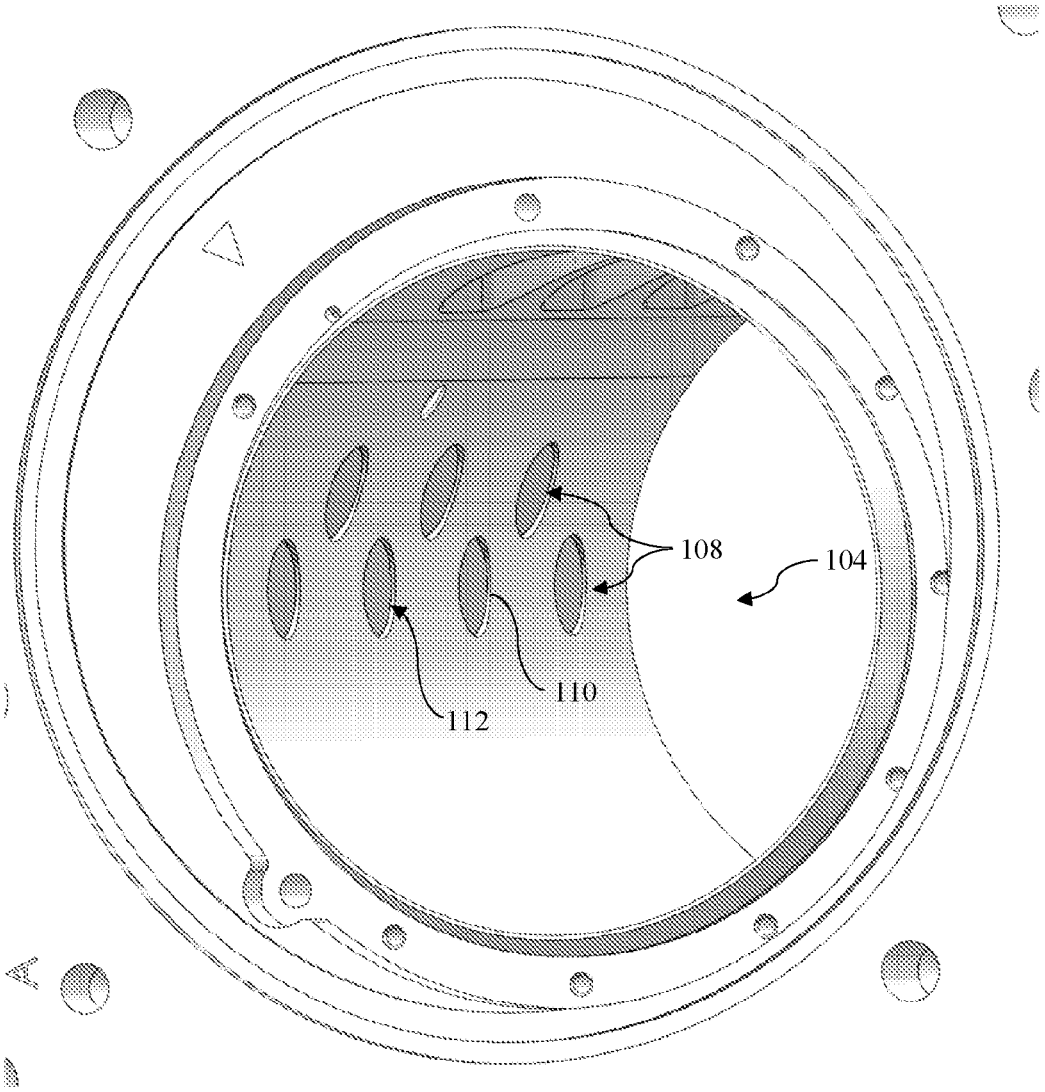
FIG. 3 is a perspective view of an interior housing of the conventional spool compressor of FIG. 2A.

In some aspects, and as illustrated in FIGS. 5 and 7, the inner wall surface 18 of the internal cavity 16 of the rotor housing assembly 12 can have a contour (e.g., a radius). The blocking surface 70 can have has a curvature with a contour (e.g., radius) that is the same as or substantially the same as the contour (e.g., radius) of the inner wall surface 18 of the inner cavity 16. In this way, the vane, as it rotates, can minimize flow over the tip seal 56 between the (leading) compression chamber and the (trailing) suction chamber. In some aspects, the blocking element 32 is configured not to rotate about the at least one guide body. For example, by supporting the blocking element 32 by two or more guide bodies 34, the blocking element 32 can be inhibited from rotating. In other aspects, cooperative geometry of the blocking element 32 and the guide body 34 can inhibit rotation of the blocking element about the guide body. For example, an elongate outer surface 37 and a corresponding elongate inner surface 41 of the receptacle 39 can inhibit rotational movement of the blocking element about the guide body. In this way, the contour of the blocking surface 70 can be closely matched with the contour of the inner wall surface 18. For example, as the tip seal 56 passes across the blocking surface 70, the tip seal can maintain a spacing from the blocking surface 70 that is no greater than 5 mm, or no greater than 4 mm, or no greater than 3 mm, or no greater than 2 mm, or no greater than 1 mm, or no greater than 0.9 mm, or no greater than 0.8 mm, or no greater than 0.7 mm, or no greater than 0.6 mm, or no greater than 0.5 mm, or no greater than 0.4 mm, or no greater than 0.3 mm, or no greater than 0.2 mm, or no greater than 0.1 mm, or between about 0.1 and about 1 mm. This is in contrast to the conventional spool compressor of FIG. 2B, in which the tip seal increases in distance from the poppet as the tip seal moves away from the center of the poppet valve and toward at the radial edges of the poppet valve.

The blocking surface 70 of each blocking element 32 can optionally have a perimeter defined by generally parallel or parallel edges 76 that extend along (optionally, parallel to) the longitudinal axis 20 and arcuate edges 78 that extend between adjacent ends of the parallel edges.

Figure 8:
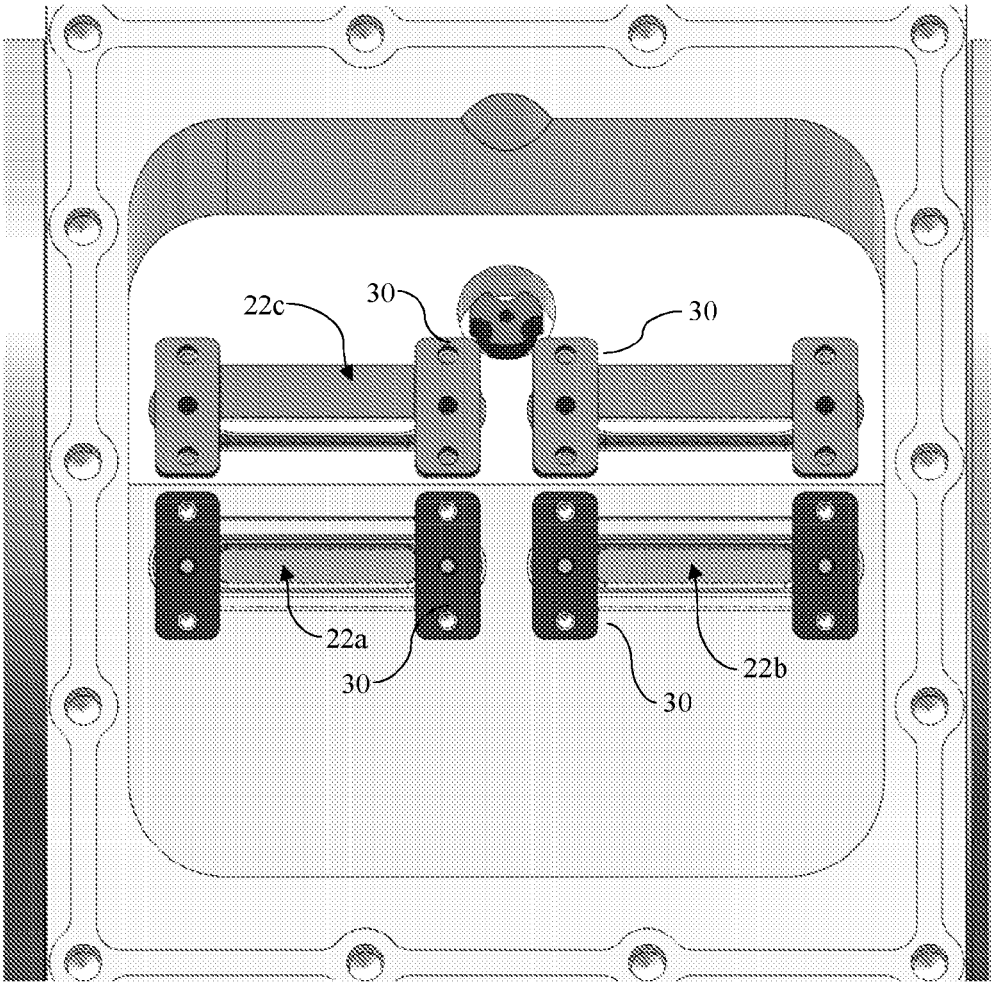
FIG. 8 is a side view of an exemplary rotary fluid-displacement assembly as disclosed herein.

In some optional aspects, and with reference to FIG. 8, the rotor housing assembly 12 can comprise a plurality of valve cavities 22 and a corresponding plurality of discharge valve assemblies 30.

Figure 4:
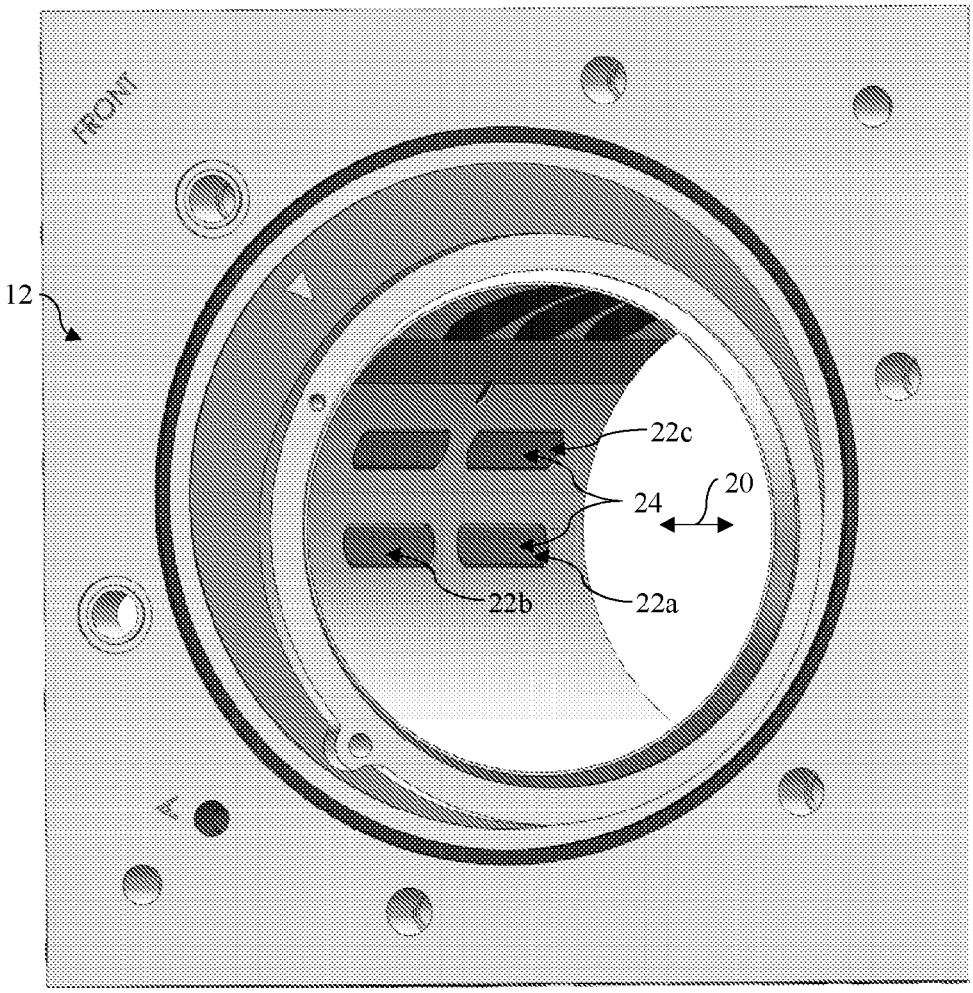
FIG. 4 is perspective view of an interior housing of an exemplary rotary fluid-displacement assembly as disclosed herein.

For example, in some aspects, and with reference to FIG. 4, the plurality of valve cavities 22 can comprise at least a first valve cavity 22*a* and a second valve cavity 22*b* that are spaced axially along the longitudinal axis. In further aspects, and with further reference to FIG. 9, the plurality of valve cavities 22 can comprise at least a first valve cavity 22*a* and a third valve cavity 22*c* that are circumferentially spaced about the longitudinal axis 20.

Referring to FIG. 9, the rotor housing assembly 12 can define an intake pathway 80 in fluid communication with the compression chamber. In some optional aspects, the rotor housing assembly 12 can define a bypass gas return path 82 that extends between the internal cavity and the intake pathway. The rotary fluid-displacement assembly 10 can further comprise a bypass valve 90 along the bypass gas return path 82. The rotor housing assembly 12 can define a bypass valve cavity 84 extending from the inner wall surface 18 and defining a portion of bypass gas return path 82. Optionally, the bypass valve cavity 84 can be is elongated along the longitudinal axis 20. The bypass valve 90 can comprise a bypass valve blocking element 92 that is configured to be movably disposed in the bypass valve cavity 84. In some optional aspects, the bypass valve blocking element 92 can be elongated along the longitudinal axis 20.

The bypass valve 90 can further comprise at least one guide body 94. The bypass valve blocking element 92 can be slidable along the at least one guide body 94 about and between a first position, in which at least a portion of the bypass valve blocking element blocks flow through the bypass gas return path, and a second position, in which at least a portion of the bypass valve blocking element is displaced from the first position and permits flow through the bypass gas return path 82. The bypass valve 90 can further comprise a valve actuator 96 that is configured to move the bypass valve blocking element 92 about and between the first position and the second position. In this way, the bypass valve 90 can be actuated in order to change the displacement of the rotary fluid-displacement assembly 10. For example, with the bypass valve 90 in the second (open) position, the compression chamber 60 does not enclose a volume to begin compressing until after the vane 50 passes the bypass valve. Rather, gas is driven through the bypass gas return path. Thus, the displacement of the rotary fluid-displacement assembly 10 is reduced. With the bypass valve 90 in the first (closed) position, the compression chamber 60 can have a larger starting volume of gas to compress.

The valve actuator 96 can be mechanically, electrically, or fluidically activated with the appropriate related control mechanisms. For example, in some optional aspects, the valve actuator 96 can be a solenoid valve.

In exemplary aspects, the bypass valve 90 can have the same geometry and structure as the discharge valve assemblies 30 described herein.

In some aspects, the opposed portions 52 of the vane 50 can each be movable axially about and between a respective first position, in which the distal end 54 of the respective portion of the vane is positioned at a first distance from the peripheral surface of the rotor, and a respective second position, in which the distal end of the respective portion of the vane is positioned at a second distance from the peripheral surface of the rotor. The distal end 54 of the respective portion 52 of the vane 50 can be constrained to be spaced proximate to the inner wall surface of the rotor housing assembly as the rotor rotates about the rotor axis of rotation. In some aspects, the first distance can be greater than the second distance. In some aspects, the second distance can be proximate to the peripheral surface of the rotor.

In use, exemplary advantages of the disclosed system include:

a) a larger flow perimeter per unit weight for the discharge valve assembly 30 than a conventional poppet valve;
b) the discharge valve assembly 30 requires less lift (e.g., blocking element 32 travel) than poppet valves to create larger flow area;
c) the lower weight and less lift result in superior dynamic performance and compressor efficiency;
d) the lower lift decreases backflow (e.g., the discharge valve assembly 30 closes more efficiently to inhibit backflow);
e) the valve cavity can be shaped to accommodate preferential fluid flow to prevent momentum/pumping losses; and
f) the contoured blocking element blocking surface can be concentric (or otherwise have the same or complementary contour) to the bore (defined by the inner wall surface) to reduce back flow between working chambers.

Exemplary Aspects

In view of the described products, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A rotary fluid-displacement assembly comprising:

a rotor housing assembly having an outer wall surface and defining an internal cavity having an inner wall surface, wherein the rotor housing assembly has a longitudinal axis, and wherein the rotor housing assembly comprises:

at least one valve cavity defined in the rotor housing assembly extending radially from the inner wall surface to the outer wall surface of the rotor housing assembly, wherein the at least one valve cavity is elongated along the longitudinal axis, wherein each valve cavity of the at least one valve cavity defines an opening in the internal cavity; and at least one discharge valve assembly;

a rotor having a peripheral surface and being positioned within the internal cavity of the rotor housing assembly, wherein the rotor is configured to rotate about a rotor axis of rotation that is parallel to or generally parallel to the longitudinal axis; and a vane having opposed portions, each opposed portion having a distal end, the opposed portions of the vane being slidably coupled to the rotor;

wherein at least portions of the peripheral surface of the rotor, portions of the inner wall surface of the rotor housing assembly, and varying portions of the vane proximate the distal ends of opposed portions of the vane define a compression chamber of varying volume as the rotor rotates about the rotor axis of rotation; and wherein each discharge valve assembly of the at least one discharge valve assembly is movable from a first closed position to a second open position when a compression chamber pressure reaches a pressure sufficient to overcome an opposing force.

Aspect 1A: The rotary fluid-displacement assembly of aspect 1, each discharge valve assembly of the at least one discharge valve assembly comprises:

a blocking element that is configured to be movably disposed in one respective valve cavity of the at least one valve cavity;

at least one guide body, wherein the blocking element is slidable along the at least one guide body about and between the first closed position, in which at least a portion of the respective blocking element blocks the respective opening of the at least one valve cavity, and the second open position, in which at least a portion of the respective blocking element is displaced from the respective opening of the at least one valve cavity; and at least one biasing element that biases the respective blocking element toward the first closed position.

Aspect 2: The rotary fluid-displacement assembly of aspect 1A, wherein the at least one biasing element of the at least one discharge valve assembly comprises a respective biasing element for each guide body of the at least one guide body.

Aspect 3: The rotary fluid-displacement assembly of aspect 1A or aspect 2, wherein the at least one guide body comprises a first guide body and a second guide body spaced along the longitudinal axis.

Aspect 4: The rotary fluid-displacement assembly of any one of aspects 1A-3, wherein the at least one guide body defines an outer surface, wherein the at least one blocking element defines a respective receptacle that receives each guide body of the at least one guide body, wherein the respective receptacle that is has an inner surface that is complementary to the outer surface of the respective guide body.

Aspect 5: The rotary fluid-displacement assembly of aspect 4, wherein the outer surface defined by the at least one guide body is cylindrical.

Aspect 6: The rotary fluid-displacement assembly of any one of aspects 1A-5, wherein the at least one guide body defines an inner bore, wherein the at least one biasing element comprises a respective spring received within the inner bore of each guide body of the at least one guide body.

Aspect 7: The rotary fluid-displacement assembly of any one aspects 1A-6, wherein the at least one blocking element comprises a blocking surface that is configured to cover the opening of the at least one valve cavity, wherein the at least one blocking element further comprises a beveled or rounded edge that extends peripherally about the blocking surface.

Aspect 8: The rotary fluid-displacement assembly of aspect 7, wherein the rotor housing assembly defines a corresponding peripheral chamfer that is configured to mate with the beveled or rounded edge of the at least one blocking element Aspect 9: The rotary fluid-displacement assembly of any one of aspects 1A-8, wherein the inner wall surface of the internal cavity of the rotor housing assembly has a radius, wherein the at least one blocking element comprises a blocking surface that is configured to cover the opening of the at least one valve cavity, wherein the blocking surface has a curvature with a radius is the same as or substantially the same as the radius of the inner wall surface of the inner cavity.

Aspect 10: The rotary fluid-displacement assembly of any one of aspects 1A-9, wherein the at least one blocking element comprises a blocking surface having a perimeter defined by generally parallel edges that extend along the longitudinal axis and arcuate edges that extend between adjacent ends of the parallel edges.

Aspect 11: The rotary fluid-displacement assembly of any one of the preceding aspects, wherein the at least one valve cavity comprises a plurality of valve cavities, and wherein the at least one discharge valve assembly comprises a plurality of discharge valve assemblies.

Aspect 12: The rotary fluid-displacement assembly of aspect 11, wherein the plurality of valve cavities comprise at least a first valve cavity and a second valve cavity that are spaced axially along the longitudinal axis.

Aspect 13: The rotary fluid-displacement assembly of aspect 11 or aspect 12, wherein the plurality of valve cavities comprise at least a first valve cavity and a second valve cavity that are circumferentially spaced about the longitudinal axis.

Aspect 14: The rotary fluid-displacement assembly of any one of the preceding aspects, wherein the rotor housing assembly defines an intake pathway in fluid communication with the compression chamber.

Aspect 15: The rotary fluid-displacement assembly of aspect 14, wherein the rotor housing assembly defines a bypass gas return path that extends between the internal cavity and the intake pathway, wherein the rotary fluid-displacement assembly further comprises a bypass valve along the bypass gas return path.

Aspect 16: The rotary fluid-displacement assembly of aspect 15, wherein the rotor housing assembly defines a bypass valve cavity extending from the inner wall surface and defining a portion of the bypass gas return path, wherein the bypass valve comprises:

a bypass valve blocking element that is configured to be movably disposed in the bypass valve cavity;

at least one guide body, wherein the bypass valve blocking element is slidable along the at least one guide body about and between a first position, in which at least a portion of the bypass valve blocking element blocks flow through the bypass gas return path, and a second position, in which at least a portion of the bypass valve blocking element is displaced from the first position and permits flow through the bypass gas return path; and a valve actuator that is configured to move the bypass valve blocking element about and between the first position and the second position.

Aspect 17: The rotary fluid-displacement assembly of any one of the preceding aspects, wherein the opposed portions of the vane are each movable axially about and between a respective first position, in which the distal end of the respective portion of the vane is positioned at a first distance from the peripheral surface of the rotor, and a respective second position, in which the distal end of the respective portion of the vane is positioned at a second distance from the peripheral surface of the rotor, wherein the distal end of the respective portion of the vane is constrained to be spaced proximate to the inner wall surface of the rotor housing assembly as the rotor rotates about the rotor axis of rotation.

Aspect 18: The rotary fluid-displacement assembly of aspect 17, wherein the first distance is greater than the second distance.

Aspect 19: The rotary fluid-displacement assembly of aspect 17, wherein the second distance is proximate to the peripheral surface of the rotor.

Aspect 20: A discharge valve assembly for a rotary fluid-displacement assembly, the discharge valve assembly comprising:

a blocking element that is configured to be movably disposed in one respective valve cavity of the at least one valve cavity, wherein the blocking element is elongated along a longitudinal axis;

at least one guide body, wherein the blocking element is slidable along the at least one guide body about and between a first position, in which at least a portion of the respective blocking element blocks the respective opening of the at least one valve cavity, and a second position, in which at least a portion of the respective blocking element is displaced from the respective opening of the at least one valve cavity, wherein the first and second positions are offset by a valve movement axis that is perpendicular to the longitudinal axis; and at least one biasing element that biases the respective blocking element toward the first position.

Aspect 21: A rotary fluid-displacement assembly, comprising:

a rotor housing assembly having an outer wall surface and defining an internal cavity having an inner wall surface, wherein the rotor housing assembly has a longitudinal axis, and wherein the rotor housing assembly defines:

a bypass gas return path that extends between the internal cavity and the intake pathway, wherein the rotary fluid-displacement assembly further comprises a bypass valve along the bypass gas return path; and a bypass valve cavity extending radially from the inner wall surface and defining a portion of the bypass gas return path, wherein the bypass valve comprises:

a bypass valve blocking element that is configured to be movably disposed in the bypass valve cavity;

at least one guide body, wherein the bypass valve blocking element is slidable along the at least one guide body about and between a first position, in which at least a portion of the bypass valve blocking element blocks flow through the bypass gas return path, and a second position, in which at least a portion of the bypass valve blocking element is displaced from the first position and permits flow through the bypass gas return path; and a valve actuator that is configured to move the bypass valve blocking element about and between the first position and the second position.

Aspect 22: A rotary fluid-displacement assembly comprising:

a rotor housing assembly having an outer wall surface and defining an internal cavity having an inner wall surface, wherein the rotor housing assembly has a longitudinal axis, and wherein the rotor housing assembly comprises:

at least one valve cavity defined in the rotor housing assembly extending radially from the inner wall surface to the outer wall surface of the rotor housing assembly, wherein each valve cavity of the at least one valve cavity defines an opening in the internal cavity; and at least one discharge valve assembly, each discharge valve assembly of the at least one discharge valve assembly comprising:

a blocking element that is configured to be movably disposed in one respective valve cavity of the at least one valve cavity;

at least one guide body, wherein the blocking element is slidable along the at least one guide body about and between a first position, in which at least a portion of the respective blocking element blocks the respective opening of the at least one valve cavity, and a second position, in which at least a portion of the respective blocking element is displaced from the respective opening of the at least one valve cavity, wherein the inner wall surface of the internal cavity of the rotor housing assembly has a radius, wherein the at least one blocking element comprises a blocking surface that is configured to cover the opening of the at least one valve cavity, wherein the blocking surface has a curvature with a radius is the same as or substantially the same as the radius of the inner wall surface of the inner cavity; and at least one biasing element that biases the respective blocking element toward the first position;

a rotor having a peripheral surface and being positioned within the internal cavity of the rotor housing assembly, wherein the rotor is configured to rotate about a rotor axis of rotation that is parallel to or generally parallel to the longitudinal axis; and a vane having opposed portions, each opposed portion having a distal end, the opposed portions of the vane being slidably coupled to the rotor;

wherein at least portions of the peripheral surface of the rotor, portions of the inner wall surface of the rotor housing assembly, and varying portions of the vane proximate the distal ends of opposed portions of the vane define a compression chamber of varying volume as the rotor rotates about the rotor axis of rotation; and wherein each discharge valve assembly of the at least one discharge valve assembly is movable from the first closed position to the second open position when a compression chamber pressure reaches a pressure sufficient to overcome an opposing force.

Aspect 23: The rotary fluid-displacement assembly of aspect 22, wherein the blocking element is configured not to rotate about the at least one guide body.

Those skilled in the art will recognize, or be able to ascertain using no more than routine experimentation, many equivalents to the specific embodiments of the method and compositions described herein. Such equivalents are intended to be encompassed by the following claims.

What is claimed is:

1. A rotary fluid-displacement assembly comprising:

a rotor housing assembly having an outer wall surface and defining an internal cavity having an inner wall surface, wherein the rotor housing assembly has a longitudinal axis, and wherein the rotor housing assembly comprises:

at least one valve cavity defined in the rotor housing assembly extending radially from the inner wall surface to the outer wall surface of the rotor housing assembly, wherein the at least one valve cavity is elongated along the longitudinal axis, wherein each valve cavity of the at least one valve cavity defines an opening in the internal cavity; and at least one discharge valve assembly, each discharge valve assembly of the at least one discharge valve assembly comprising:

a blocking element that is configured to be movably disposed in one respective valve cavity of the at least one valve cavity;

at least one guide body, wherein the blocking element is slidable along the at least one guide body about and between a first position, in which at least a portion of the respective blocking element blocks the respective opening of the at least one valve cavity, and a second position, in which at least a portion of the respective blocking element is displaced from the respective opening of the at least one valve cavity; and at least one biasing element that biases the respective blocking element toward the first position;

a rotor having a peripheral surface and being positioned within the internal cavity of the rotor housing assembly, wherein the rotor is configured to rotate about a rotor axis of rotation that is parallel to or generally parallel to the longitudinal axis; and a vane having opposed portions, each opposed portion having a distal end, the opposed portions of the vane being slidably coupled to the rotor;

wherein at least portions of the peripheral surface of the rotor, portions of the inner wall surface of the rotor housing assembly, and varying portions of the vane proximate the distal ends of opposed portions of the vane define a compression chamber of varying volume as the rotor rotates about the rotor axis of rotation; and wherein each discharge valve assembly of the at least one discharge valve assembly is movable from the first closed position to the second open position when a compression chamber pressure reaches a pressure sufficient to overcome an opposing force.

2. The rotary fluid-displacement assembly of claim 1, wherein the at least one biasing element of the at least one discharge valve assembly comprises a respective biasing element for each guide body of the at least one guide body.

3. The rotary fluid-displacement assembly of claim 1, wherein the at least one guide body comprises a first guide body and a second guide body spaced along the longitudinal axis.

4. The rotary fluid-displacement assembly of claim 1, wherein the at least one guide body defines an outer surface, wherein the at least one blocking element defines a respective receptacle that receives each guide body of the at least one guide body, wherein the respective receptacle that is has an inner surface that is complementary to the outer surface of the respective guide body.

5. The rotary fluid-displacement assembly of claim 4, wherein the outer surface defined by the at least one guide body is cylindrical.

6. The rotary fluid-displacement assembly of claim 1, wherein the at least one guide body defines an inner bore, wherein the at least one biasing element comprises a respective spring received within the inner bore of each guide body of the at least one guide body.

7. The rotary fluid-displacement assembly of claim 1, wherein the at least one blocking element comprises a blocking surface that is configured to cover the opening of the at least one valve cavity, wherein the at least one blocking element further comprises a beveled or rounded edge that extends peripherally about the blocking surface.

8. The rotary fluid-displacement assembly of claim 7, wherein the rotor housing assembly defines a corresponding peripheral chamfer that is configured to mate with the beveled or rounded edge of the at least one blocking element.

9. The rotary fluid-displacement assembly of claim 1, wherein the inner wall surface of the internal cavity of the rotor housing assembly has a radius, wherein the at least one blocking element comprises a blocking surface that is configured to cover the opening of the at least one valve cavity, wherein the blocking surface has a curvature with a radius is the same as or substantially the same as the radius of the inner wall surface of the inner cavity.

10. The rotary fluid-displacement assembly of claim 1, wherein the at least one blocking element comprises a blocking surface having a perimeter defined by generally parallel edges that extend along the longitudinal axis and arcuate edges that extend between adjacent ends of the parallel edges.

11. The rotary fluid-displacement assembly of claim 1, wherein the at least one valve cavity comprises a plurality of valve cavities, and wherein the at least one discharge valve assembly comprises a plurality of discharge valve assemblies.

12. The rotary fluid-displacement assembly of claim 11, wherein the plurality of valve cavities comprise at least a first valve cavity and a second valve cavity that are spaced axially along the longitudinal axis.

13. The rotary fluid-displacement assembly of claim 11, wherein the plurality of valve cavities comprise at least a first valve cavity and a second valve cavity that are circumferentially spaced about the longitudinal axis.

14. The rotary fluid-displacement assembly of claim 1, wherein the rotor housing assembly defines an intake pathway in fluid communication with the compression chamber.

15. The rotary fluid-displacement assembly of claim 14, wherein the rotor housing assembly defines a bypass gas return path that extends between the internal cavity and the intake pathway, wherein the rotary fluid-displacement assembly further comprises a bypass valve along the bypass gas return path.

16. The rotary fluid-displacement assembly of claim 15, wherein the rotor housing assembly defines a bypass valve cavity extending from the inner wall surface and defining a portion of the bypass gas return path, wherein the bypass valve comprises:

a bypass valve blocking element that is configured to be movably disposed in the bypass valve cavity;

at least one guide body, wherein the bypass valve blocking element is slidable along the at least one guide body about and between a first position, in which at least a portion of the bypass valve blocking element blocks flow through the bypass gas return path, and a second position, in which at least a portion of the bypass valve blocking element is displaced from the first position and permits flow through the bypass gas return path; and a valve actuator that is configured to move the bypass valve blocking element about and between the first position and the second position.

17. The rotary fluid-displacement assembly of claim 1, wherein the opposed portions of the vane are each movable axially about and between a respective first position, in which the distal end of the respective portion of the vane is positioned at a first distance from the peripheral surface of the rotor, and a respective second position, in which the distal end of the respective portion of the vane is positioned at a second distance from the peripheral surface of the rotor, wherein the distal end of the respective portion of the vane is constrained to be spaced proximate to the inner wall surface of the rotor housing assembly as the rotor rotates about the rotor axis of rotation.

18. The rotary fluid-displacement assembly of claim 17, wherein the first distance is greater than the second distance.

19. A discharge valve assembly for a rotary fluid-displacement assembly, the discharge valve assembly comprising:

a blocking element that is configured to be movably disposed in one respective valve cavity of the at least one valve cavity, wherein the blocking element is elongated along a longitudinal axis;

at least one guide body, wherein the blocking element is slidable along the at least one guide body about and between a first position, in which at least a portion of the respective blocking element blocks the respective opening of the at least one valve cavity, and a second position, in which at least a portion of the respective blocking element is displaced from the respective opening of the at least one valve cavity, wherein the first and second positions are offset by a valve movement axis that is perpendicular to the longitudinal axis; and at least one biasing element that biases the respective blocking element toward the first position.

20. A rotary fluid-displacement assembly, comprising:

a rotor housing assembly having an outer wall surface and defining an internal cavity having an inner wall surface, wherein the rotor housing assembly has a longitudinal axis, and wherein the rotor housing assembly defines:

a bypass gas return path that extends between the internal cavity and the intake pathway, wherein the rotary fluid-displacement assembly further comprises a bypass valve along the bypass gas return path; and a bypass valve cavity extending radially from the inner wall surface and defining a portion of the bypass gas return path, wherein the bypass valve comprises:

a bypass valve blocking element that is configured to be movably disposed in the bypass valve cavity;

at least one guide body, wherein the bypass valve blocking element is slidable along the at least one guide body about and between a first position, in which at least a portion of the bypass valve blocking element blocks flow through the bypass gas return path, and a second position, in which at least a portion of the bypass valve blocking element is displaced from the first position and permits flow through the bypass gas return path; and a valve actuator that is configured to move the bypass valve blocking element about and between the first position and the second position.

* * * * *